US008734178B2

(12) United States Patent
Inagaki et al.

(10) Patent No.: US 8,734,178 B2
(45) Date of Patent: May 27, 2014

(54) ELECTRICAL PLUG-PROVIDED CORD

(75) Inventors: Kazuhito Inagaki, Osaka (JP); Masaaki Yamamoto, Osaka (JP)

(73) Assignee: Fuji Electric Wire Industries Co., Ltd., Osaka (JP)

( * ) Notice: Subject to any disclaimer, the term of this patent is extended or adjusted under 35 U.S.C. 154(b) by 35 days.

(21) Appl. No.: 13/428,116

(22) Filed: Mar. 23, 2012

(65) Prior Publication Data

US 2013/0115799 A1 May 9, 2013

(30) Foreign Application Priority Data

Nov. 8, 2011 (JP) ..... 2011-244277

(51) Int. Cl.
*H01R 13/62* (2006.01)

(52) U.S. Cl.
USPC ..... 439/369

(58) Field of Classification Search
USPC ..... 439/369, 736, 606, 460, 346; 264/255; 174/67
See application file for complete search history.

(56) References Cited

U.S. PATENT DOCUMENTS 1,601,255 A * 9/1926 Marra ..... 439/460
D178,359 S * 7/1956 Gombar ..... D13/138.1
3,141,054 A * 7/1964 Francis ..... 264/255
3,668,779 A * 6/1972 Turner ..... 29/858
4,398,785 A * 8/1983 Hedrick ..... 439/695
4,495,130 A * 1/1985 Hedrick ..... 264/255
4,582,388 A * 4/1986 Swaffield ..... 439/606
4,776,813 A * 10/1988 Wilson et al. ..... 439/587
5,006,286 A * 4/1991 Dery et al. ..... 264/408
5,152,944 A * 10/1992 Khalil ..... 264/135
5,518,415 A * 5/1996 Sano ..... 439/204
5,753,861 A * 5/1998 Hansen et al. ..... 174/93
5,786,053 A * 7/1998 Andrenacci et al. ..... 428/36.9
6,152,761 A * 11/2000 Wellinsky et al. ..... 439/456
6,230,405 B1 * 5/2001 Liu et al. ..... 29/858
6,231,358 B1 * 5/2001 Kerr et al. ..... 439/140
6,248,380 B1 * 6/2001 Kocher et al. ..... 426/127
6,306,155 B1 * 10/2001 Chandler et al. ..... 606/205
6,355,318 B1 * 3/2002 Tailor et al. ..... 428/34.9
6,468,095 B2 * 10/2002 Kerr et al. ..... 439/140
6,485,325 B1 * 11/2002 Fukuda ..... 439/465
6,485,334 B2 * 11/2002 Hattori et al. ..... 439/604
6,538,203 B1 * 3/2003 Nolle et al. ..... 174/84 R
6,709,253 B2 * 3/2004 Hattori et al. ..... 425/116
6,740,814 B2 * 5/2004 Ohta et al. ..... 174/68.1

(Continued)

FOREIGN PATENT DOCUMENTS

JP 2003-178835 A 6/2003

*Primary Examiner* — Alexander Gilman
(74) *Attorney, Agent, or Firm* — Osha Liang LLP

(57) ABSTRACT

An electrical plug-provided cord has a cord including lead wires and an outer cover for covering the lead wires, an electrical plug including plug blades connected to the lead wires at a tip of the cord and a plug outer housing for covering a part of the cord and a part of the plug blades from base parts of the plug blades to the outer cover at a tip part of the cord, and a coupling member which surrounds the tip part of the cord in close contact and is coupled to the plug outer housing by thermal welding. The plug outer housing is formed of a synthetic resin. At least an interface of the coupling member with the plug outer housing is formed of a heat-weldable material which is thermally weldable with the plug outer housing.

8 Claims, 11 Drawing Sheets

(56) References Cited

U.S. PATENT DOCUMENTS

| | | | | |
|---|---|---|---|---|
| D519,456 | S * | 4/2006 | Wu | D13/137.1 |
| 7,230,214 | B2 * | 6/2007 | Kirby | 219/535 |
| 7,798,838 | B2 * | 9/2010 | Grieff et al. | 439/346 |
| 8,101,861 | B1 * | 1/2012 | Shotey et al. | 174/67 |
| 2008/0132109 | A1 * | 6/2008 | Landis et al. | 439/441 |
| 2009/0124112 | A1 * | 5/2009 | Sokol et al. | 439/367 |
| 2011/0021061 | A1 * | 1/2011 | Bishop et al. | 439/357 |

* cited by examiner

ELECTRICAL PLUG-PROVIDED CORD

BACKGROUND OF THE INVENTION

1. Field of the Invention

The present invention relates to an electrical plug-provided cord including an electrical plug at a tip of a cord.

2. Description of the Prior Art

An example of electrical plug-provided cord is, as described in Patent Document 1, a power supply plug-provided cord including a power supply plug, to be inserted into an electrical outlet, at a tip of a cord.

The power supply plug-provided cord includes a cord including lead wires covered with an outer cover formed of, for example, rubber, two plug blades each having a base part connected to the lead wires by caulking or the like, a tang formed of a hard resin for covering the base parts of the plug blades and uncovered parts of the lead wires which are connected with the plug blades, and a plug outer housing formed of a soft resin for covering a part of the cord and a part of the plug blades, specifically, elements from the base parts of the plug blades to the outer cover at a tip of the cord.

The tang of the power supply plug-provided cord includes covered secured parts for covering and securing the base parts of the plug blades and parts of the lead wires connected with the plug blades, and a bridge part for connecting the covered secured parts. A cord is wound around the bridge part. It is considered that owing to this structure, even when the cord is strongly pulled out from an electrical outlet, the parts of the lead wires connected with the plug blades are prevented from being broken despite a strong tensile force applied on the parts of the lead wires.

In a general power supply plug-provided cord, the plug outer housing and the outer cover of the cord are formed of different materials and are not integrally coupled to each other.

A power supply plug-provided cord having such a structure involves an undesirable possibility that, especially when inserted into an outdoor electrical outlet, moisture running on the cord invades the inside of the power supply plug through a gap between the plug outer housing and the outer cover of the cord.

PRIOR ART DOCUMENT

Patent Document

Patent Document 1: Japanese Laid-Open Patent Publication No. 2003-178835

SUMMARY OF THE INVENTION

Problems to be Solved by the Invention

Thus, the present invention has an object of providing an electrical plug-provided cord for preventing lead wires from being broken at parts thereof connected with plug blades even when the cord is forcibly pulled out and also preventing invasion of moisture running on the cord into the inside of an electrical plug thereof.

Means for Solving the Invention

The present invention is directed to an electrical plug-provided cord, comprising a cord including lead wires and an outer cover for covering the lead wires; an electrical plug including plug blades connected to the lead wires at a tip of the cord and a plug outer housing for covering a part of the cord and a part of the plug blades from base parts of the plug blades to the outer cover on a tip part of the cord, the plug outer housing being formed of a synthetic resin; and a coupling member which surrounds the tip part of the cord in close contact therewith and is coupled to the plug outer housing by thermal welding, wherein at least an interface of the coupling member with the plug outer housing is formed of a heat-weldable material which is thermally weldable with the plug outer housing.

The electrical plug may be a power supply plug, a plug for a computer, a plug for communication, an plug for an audio/visual device or any of various other plugs.

The plug outer housing may be formed of a material containing poly(vinyl chloride) (PVC). Alternatively, the plug outer housing may be formed of a material containing polystyrene (PS), polyethylene (PE), polypropylene (PP), thermoplastic elastomer (TPE), polyamide or the like.

The heat-weldable material may be a material containing, for example, a hot melt adhesive such as a polyamide-based hot melt adhesive, an ethylene vinyl acetate-based hot melt adhesive, a polyolefin-based hot melt adhesive, a moisture-curable urethane-based hot melt adhesive or the like; polystyrene (PS); polyethylene (PE); polypropylene (PP); thermoplastic elastomer (TPE); polyamide or the like.

According to the present invention, the lead wires can be prevented from being broken at parts thereof connected with the plug blades even when the cord is forcibly pulled out, and also the invasion of the moisture running on the cord into the inside of the electrical plug can be prevented.

In an embodiment of the present invention, the coupling member may be formed of a hot melt adhesive.

According to the present invention, the coupling member can be coupled to the plug outer housing and also the outer cover of the cord in close contact therewith in an airtight manner by thermal welding. Therefore, the breakage of the lead wires and the invasion of the moisture into the inside of the electrical plug can be prevented with certainty.

In an embodiment of the present invention, the coupling member may have a two-layer structure including an outer circumferential layer and an inner circumferential layer; and the outer circumferential layer may be formed of the heat-weldable material, and the inner circumferential layer may be formed of an adhesive which is bondable to the outer circumferential layer and the cord.

According to the present invention, the coupling member can be bonded to the outer cover of the cord, and thus the breakage of the lead wires and the invasion of the moisture into the inside of the electrical plug can be prevented with certainty.

In an embodiment of the present invention, the coupling member may be formed of a heat-contractable material.

The heat-contractable material may be a material obtained by crosslinking poly (vinyl chloride) (PVC), polystyrene (PS), polyethylene (PE), polypropylene (PP), thermoplastic elastomer (TPE), polyamide or the like.

According to the present invention, the coupling member is thermally contracted and thus can be provided in close contact with the cord in the state of tightening the cord.

In an embodiment of the present invention, the coupling member may have a tube-like shape.

According to the present invention, the coupling member can be coupled to the plug outer housing, and also can be coupled to (in close contact with) the outer cover, in a large area. Therefore, the breakage of the lead wires and the invasion of the moisture into the inside of the electrical plug can be prevented with certainty.

In an embodiment of the present invention, a cable tie may be wound around an outer circumference of the coupling member.

According to the present invention, the close contact of the coupling member to the tip part of the cord can be made stronger. In addition, when the cord is forcibly pulled out, the cable tie is engaged with the plug outer housing. Therefore, the breakage of the lead wires can be prevented with certainty. Moreover, these effects can be provided by a space-saving structure.

In an embodiment of the present invention, a cable tie may be wound around an outer circumference of the outer cover on the tip part of the cord.

According to the present invention, when the cord is forcibly pulled out, the cable tie is engaged with the plug outer housing. In addition, the coupling member can be coupled to the plug outer housing in a large area. Therefore, the breakage of the lead wires and the invasion of the moisture into the inside of the electrical plug can be prevented with certainty.

The present invention is also directed to a method for producing an electrical plug-provided cord including a cord which includes lead wires and an outer cover for covering the lead wires; and an electrical plug which includes plug blades connected to the lead wires at a tip of the cord and a plug outer housing for covering a part of the cord and a part of the plug blades from base parts of the plug blades to the outer cover on a tip part of the cord, the plug outer housing being formed of a synthetic resin. The method comprises providing a coupling member so as to surround the tip part of the cord in close contact therewith, wherein at least an interface of the coupling member with the plug outer housing is formed of a heat-weldable material which is thermally weldable with the plug outer housing; and coupling the coupling member and the plug outer housing to each other by thermal welding by heat of a melted resin which is generated during insert molding performed to form the plug outer housing.

Effect of the Invention

According to the present invention, an electrical plug-provided cord for preventing lead wires from being broken at parts thereof connected with plug blades even when the cord is forcibly pulled out and also preventing invasion of moisture running on the cord into the inside of an electrical plug thereof can be provided.

DESCRIPTION OF THE PREFERRED EMBODIMENTS

Embodiment 1

Hereinafter, with reference to FIG. 1 through FIG. 8, a power supply plug-provided cord 1 in Embodiment 1 according to the present invention will be described. In this embodiment, the power supply plug-provided cord 1 including two plug blades 30 will be described. A power supply plug-provided cord of a type usable for, for example, a three-phase AC power supply has substantially the same structure.

Figure 1:
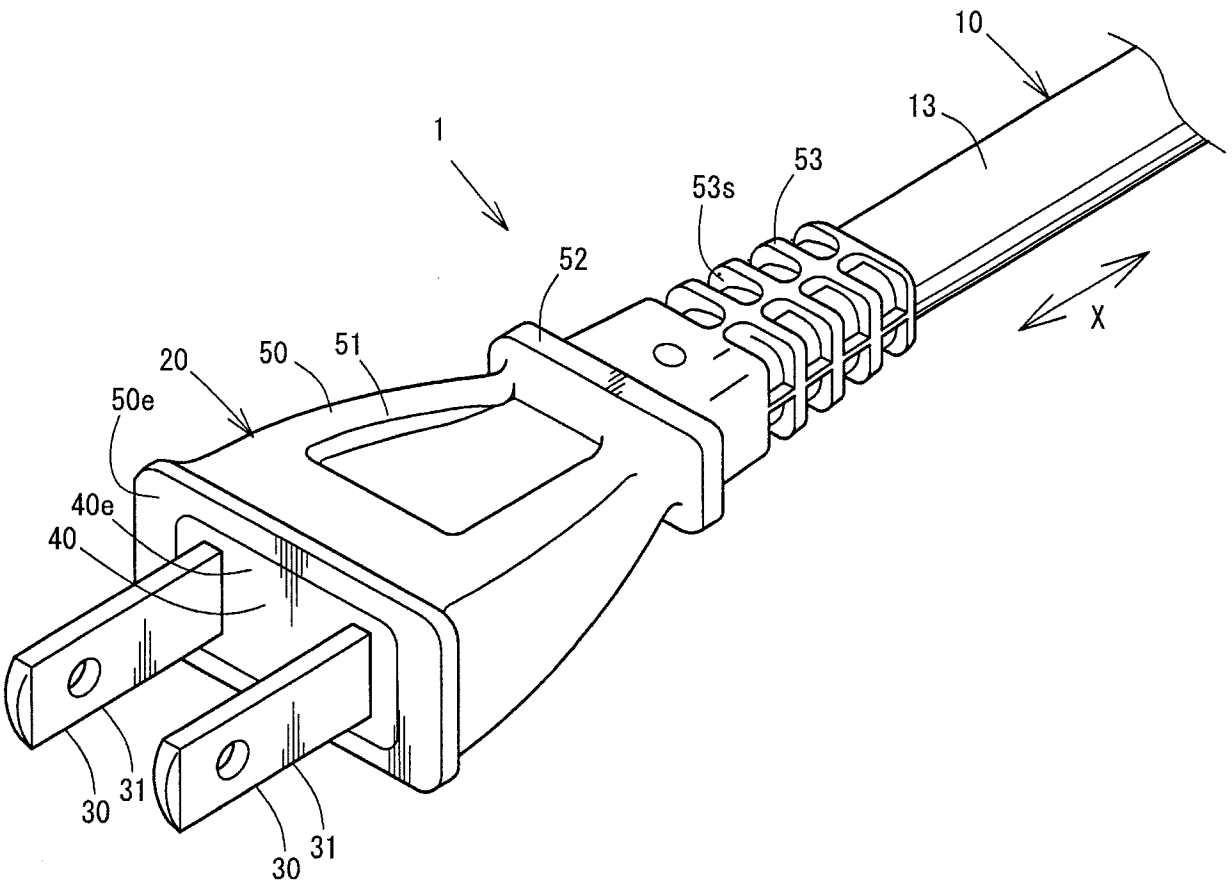
FIG. 1 is an isometric view of a power supply plug-provided cord.
Figure 2:
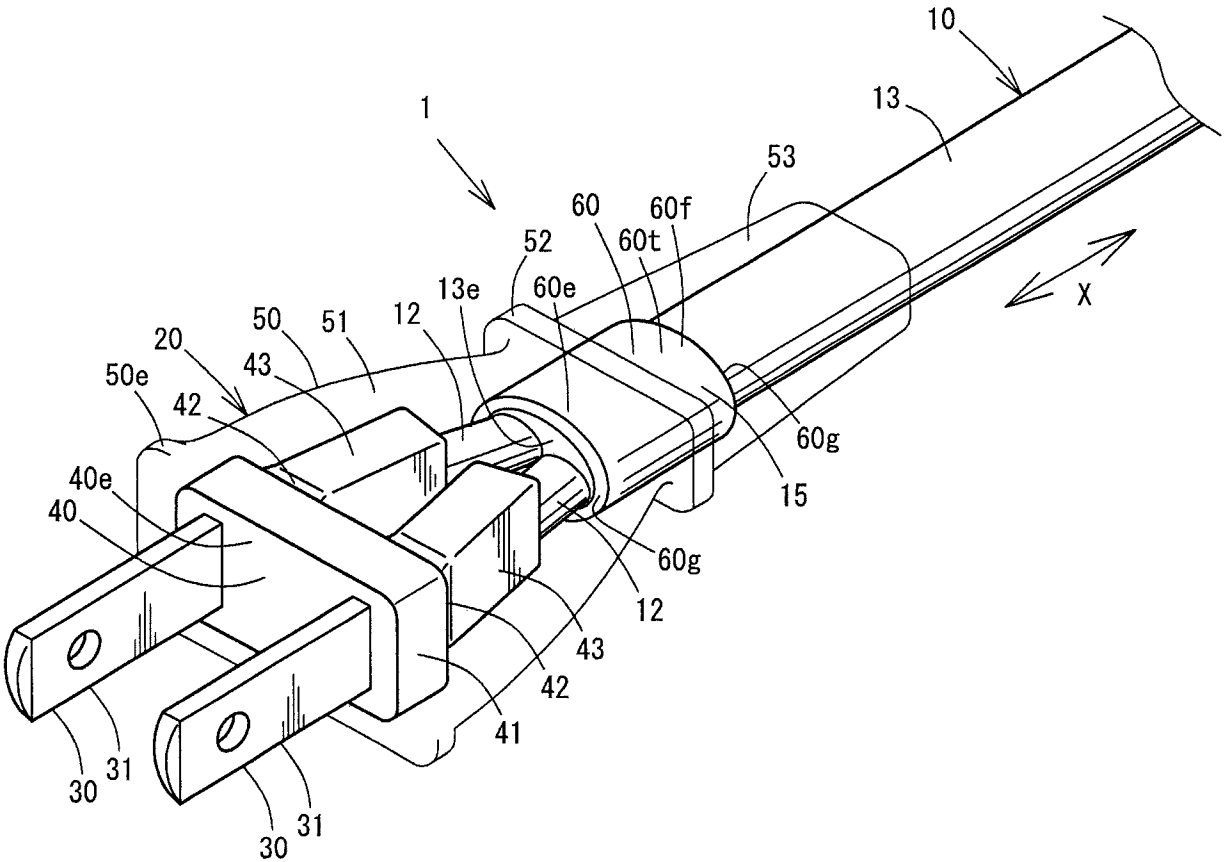
FIG. 2 is an isometric view showing an inner structure of the power supply plug-provided cord.
Figure 3:
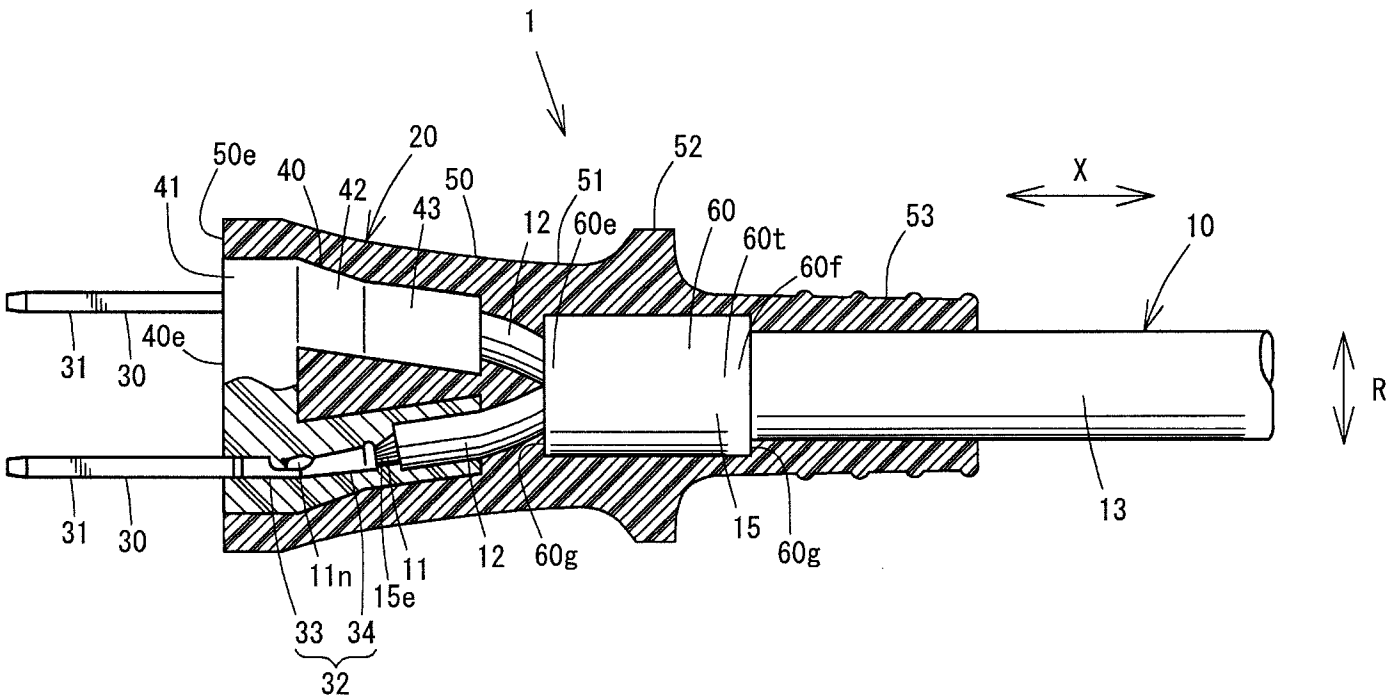
FIG. 3 is a partial horizontal cross-sectional view of the power supply plug-provided cord, taken along a plane extending in a longitudinal direction X and crossing both of plug blades generally perpendicularly.
Figure 4:
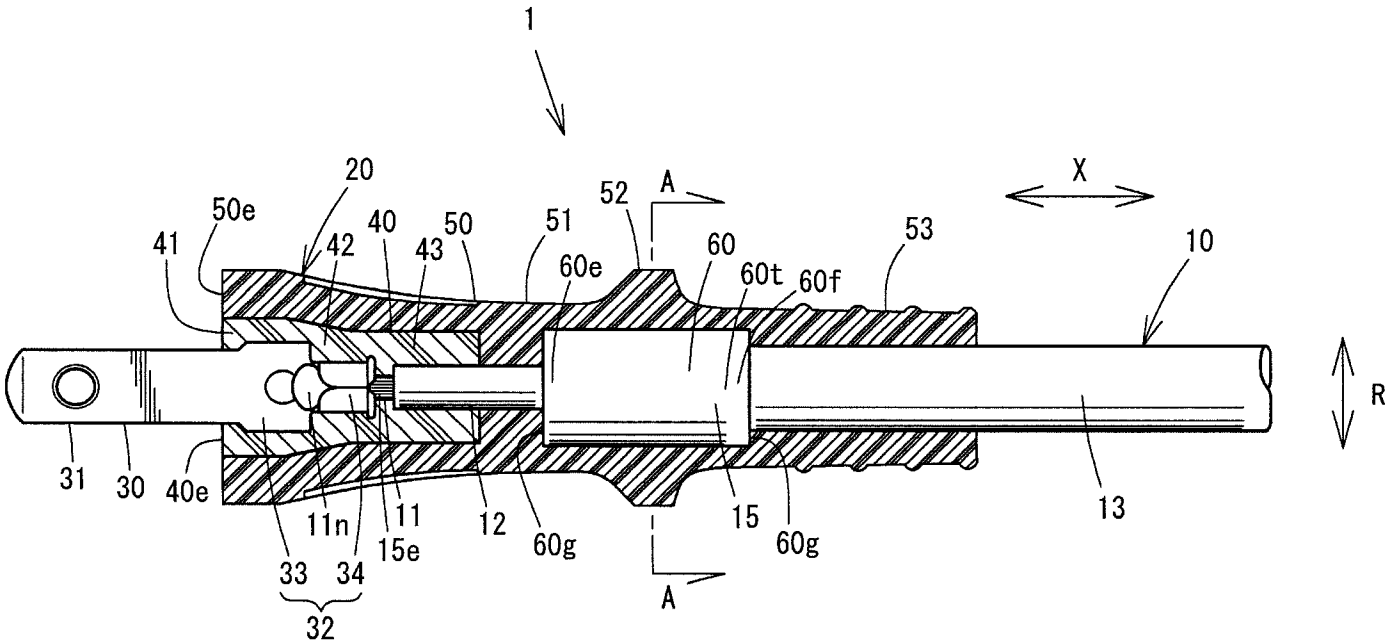
FIG. 4 is a partial vertical cross-sectional view of the power supply plug-provided cord, which is perpendicular to the cross-section in FIG. 3.
Figure 5:
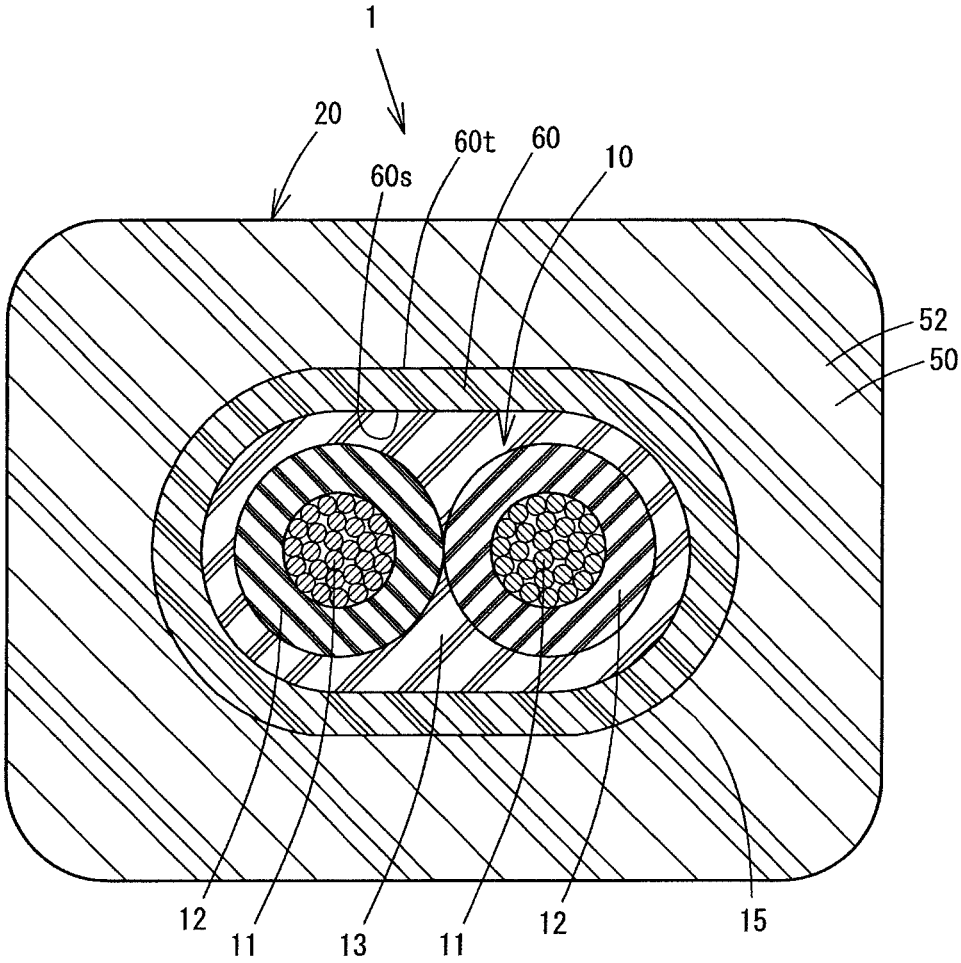
FIG. 5 is an enlarged cross-sectional view taken along line A-A in FIG. 4.

FIG. 1 is an isometric view of the power supply plug-provided cord 1, and FIG. 2 is an isometric view showing an inner structure of the power supply plug-provided cord 1. FIG. 2 corresponds to FIG. 1. FIG. 3 is a partial horizontal cross-sectional view of the power supply plug-provided cord 1, taken along a plane extending in a longitudinal direction X and crossing both of the two plug blades 30 generally perpendicularly. FIG. 4 is a partial vertical cross-sectional view of the power supply plug-provided cord 1, which is perpendicular to the cross-section in FIG. 3. FIG. 5 is an enlarged cross-sectional view taken along line A-A in FIG. 4.

Figure 6:
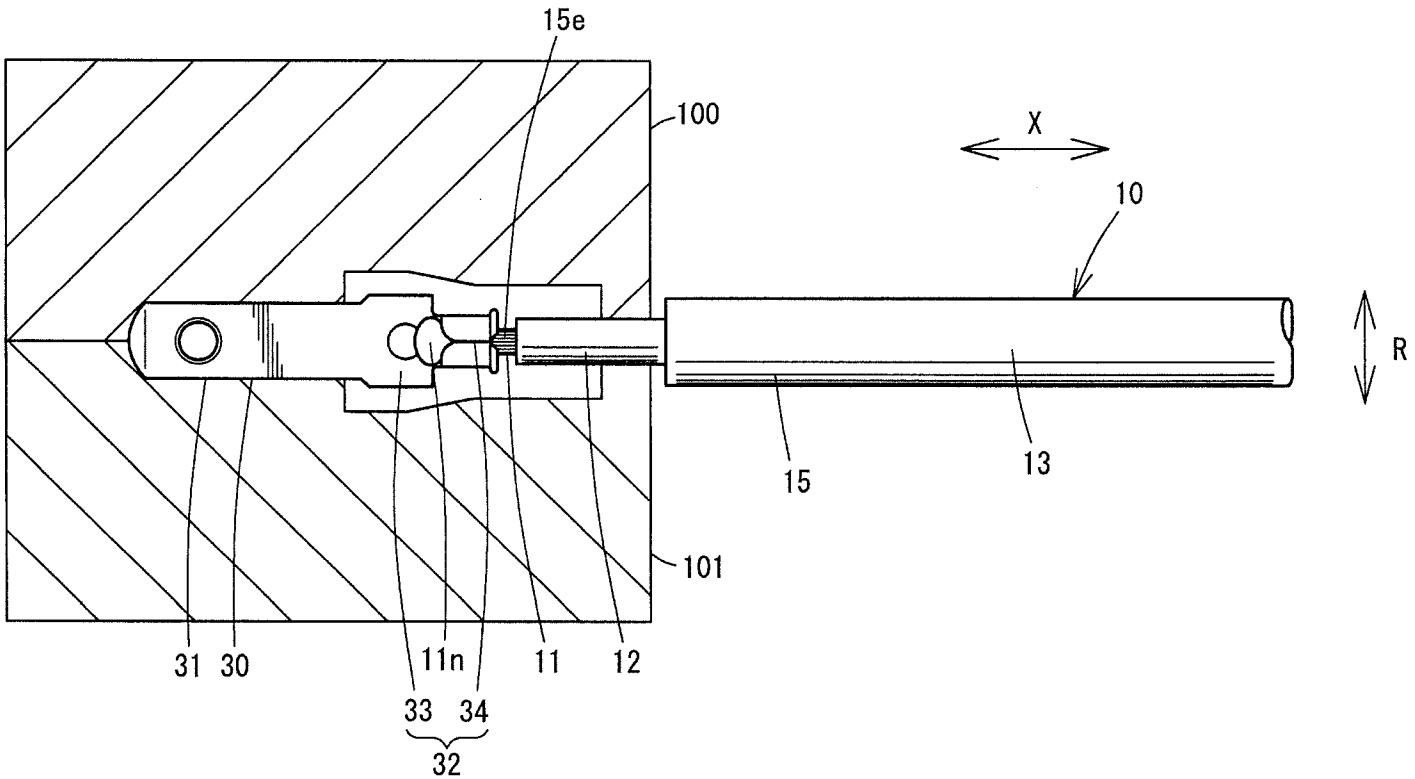
FIG. 6 illustrates a step for forming a tang.
Figure 7:
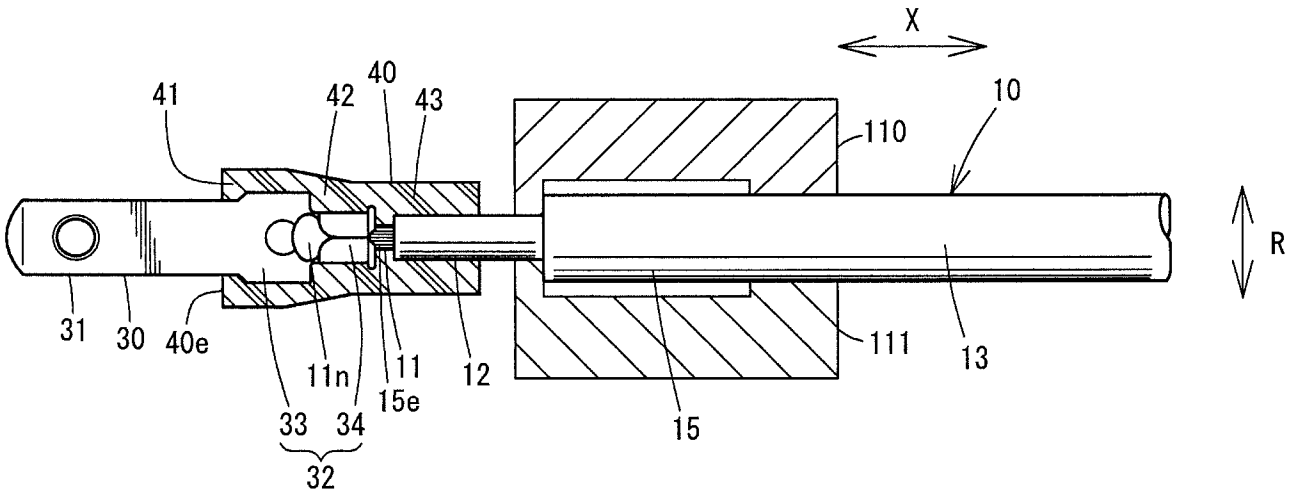
FIG. 7 illustrates a step for forming a coupling tube.
Figure 8:
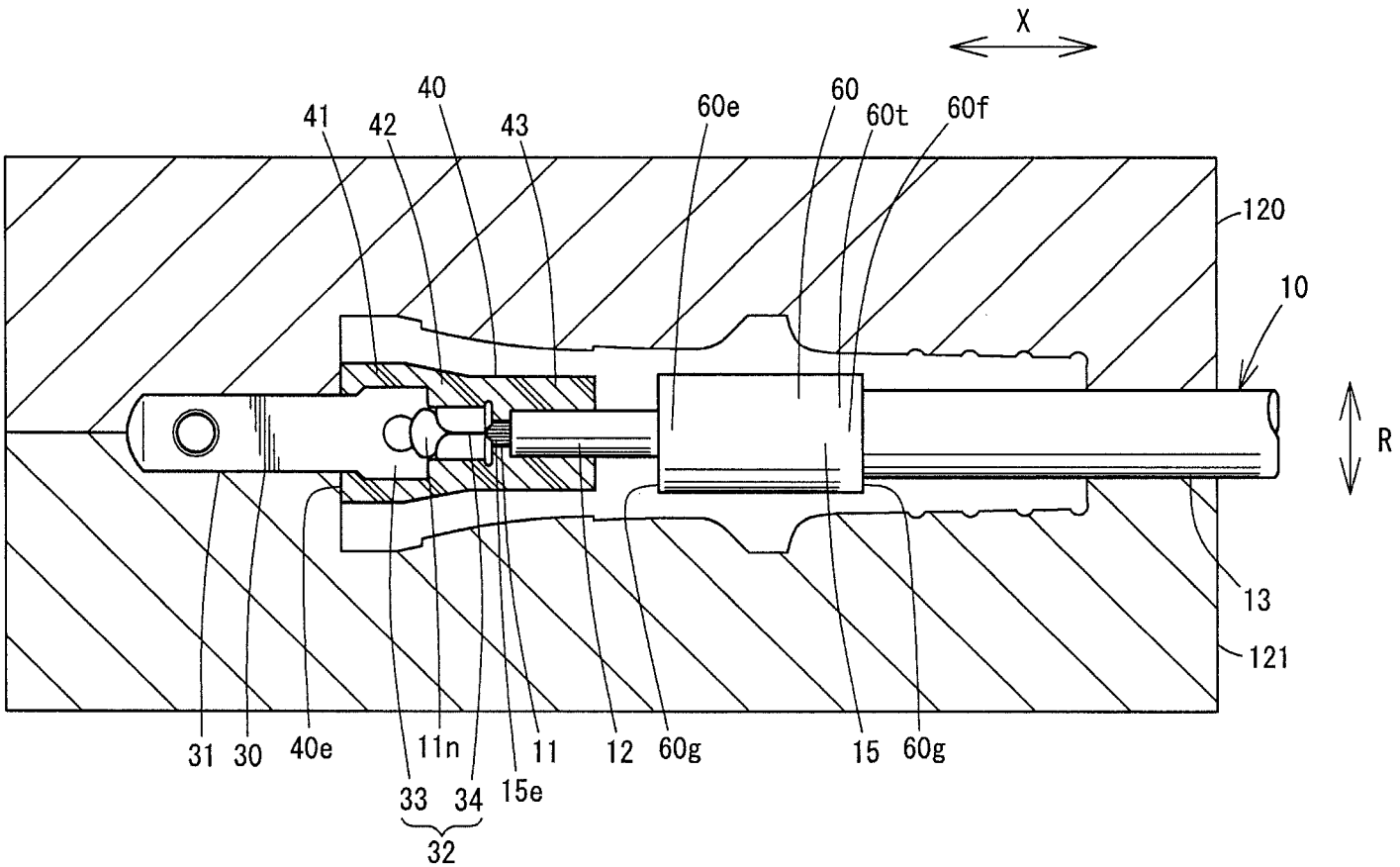
FIG. 8 illustrates a step for forming a plug outer housing.

FIG. 6 illustrates insert molding performed to form a tang 40. FIG. 7 illustrates injection molding performed to form a coupling tube 60. FIG. 8 illustrates insert molding performed to forma plug outer housing 50 after the injection molding shown in FIG. 7. FIGS. 6 through 8 show stages before the tang 40, the coupling tube 60 and the plug outer housing 50 are formed, respectively.

The power supply plug-provided cord 1 includes a cord 10 and a power supply plug 20 provided at a tip part 15 of the cord 10.

Specifically, in the power supply plug-provided cord 1, a coupling tube 60 formed of a hot melt adhesive of a polyamide resin is coupled to the tip part 15 of the cord 10 by thermal welding. Also in the power supply plug-provided cord 1, uncovered parts of lead wires 11 are connected to connection parts 32 of the plug blades 32 at tips 15*e* of the cord 10.

Further in the power supply plug-provided cord 1, parts for connecting the lead wires 11 and the plug blades 32 are covered with the tang 40 to be insulating. The tang 40 is formed of a thermoplastic resin such as nylon 66 or the like, which is hard and has high insulating property and high heat resistance.

The plug outer housing 50 is formed of poly(vinyl chloride) (PVC), which is a thermoplastic resin softer than nylon 66. The plug outer housing 50 covers, with no gap, a part of the cord 10 and a part of the plug blades 30, specifically, elements from the connection parts 32 of the plug blades 30 to a position of the cord 10 which is distanced from the coupling tube 60 provided on the tip part 15 of the cord 10 in a direction which is along a longitudinal direction X and away from the plug blades 30. The coupling tube 60 is also coupled to the plug outer housing 50 by thermal welding.

In more detail, the cord 10 includes two sets of lead wires 11, inner covers 12 for covering outer circumferences of the two sets of lead wires 11 independently, and an outer cover 13 for covering the inner covers 12 in the form of binding the two sets of lead wires 11 covered with the inner covers 12. The inner covers 12 and the outer cover 13 are formed of a rubber material such as polychloroprene, ethylene propylene rubber, chlorosulfonated polyethylene rubber or the like.

In the tip part 15 of the cord 10, the two sets of lead wires 11 each covered with the inner cover 12 are separated from each other at a position where the inner covers 12 come out from the outer cover 13, and extend to be more distanced from each other as approaching the tips 15*e*. At the tips 15*e* of the cord 10, the lead wires 11 are exposed.

The coupling tube 60 is formed of a flexible hot melt adhesive of a polyamide resin as described above and has a tube-like shape having a length of several centimeters and a thickness of several millimeters.

The coupling tube 60 has an inner circumferential surface 60*s*. Because of heat generated when the coupling tube 60 is formed by molding, the entirety of the inner circumferential surface 60*s* is thermally welded to the outer cover 13 at the tip part 15 of the cord 10. Thus, the coupling tube 60 is coupled to the outer cover 13 in close contact therewith in an airtight manner.

The coupling tube 60 has an outer circumferential surface 60*t*. Because of heat generated when the plug outer housing 50 is formed by molding, the plug outer housing 50 is thermally welded to the entirety of the outer circumferential surface 60*t*. Thus, the coupling tube 60 is coupled to the plug outer housing 50 in close contact therewith in an airtight manner.

Namely, the entirety of the inner circumferential surface 60*s* of the coupling tube 60 is in close contact with the outer cover 13 of the cord 10, and also the entirety of the outer circumferential surface 60*t* of the coupling tube 60 is in close contact with the plug outer housing 50.

Owing to this, the close contact between the outer cover 13 of the cord 10 and the plug outer housing 50 is secured along the entire circumference of the cord 10. The coupling tube 60, which is formed of a hot melt adhesive of a polyamide resin, can be maintained in such a coupled state in a wide temperature range and has an appropriate level of flexibility even at a low temperature. Therefore, the above-mentioned close contact can be secured even in a severe environment of use such as outdoors, or in a severe state of use such that, for example, the cord 10 is bent at a large angle with respect to the power supply plug 20.

The coupling tube 60 is provided in the state where a tip 60*e* thereof is aligned with a tip 13*e* of the outer cover 13.

The plug blades 30 each include an insertion part 31 on a tip side thereof which is to be inserted into an electrical outlet and the connection part 32 at a base part side thereof which is connectable with the lead wires 11 of the cord 10. The connection part 32 includes a wider part 33 which is wider than the insertion part 31, and a caulking part 34 which is connectable with the lead wires 11 by caulking. The wider part 33 is positioned immediately adjacent to, and on the base part side with respect to, the insertion part 31, and the caulking part 34 is positioned immediately adjacent to, and on the base part side with respect to, the wider part 33.

The lead wires 11 exposed at each tip 15*e* of the cord 10 are connected in pressure contact with the caulking part 34 of the connection part 32 of the corresponding blade 30 by caulking. The lead wires 11 are spot-welded to the wider part 33 of the connection part 32, and thus are connected to the plug blade 30 also by a nugget 11*n* formed by the spot welding.

By the above-described structure, on the base part side of each plug blade 30, the plug blade 30 and the lead wires 11 are connected to each other by caulking at the caulking part 34 and by the formation of the nugget 11*n* generated by the spot welding.

The tang 40 covers a part of the cord 10 and a part of the plug blades 30, specifically, elements from the connection parts 32 of the plug blades 30 to the uncovered inner covers 12 at the tip part 15 of the cord 10. In more detail, the tang 40 includes a holding part 41, on a tip side thereof, for holding the wider parts 33 of the two plug blades 30 such that the wider parts 33 are distanced from each other by a prescribed interval and are also parallel to each other. The tang 40 also includes inclining parts 43, on a rear side thereof, which extend obliquely so as to be more distanced from each other as approaching the holding part 41. The tang 40 further includes intermediate parts 42, each between the holding part 41 and the corresponding inclining part 43. The intermediate parts 42 each become gradually thicker toward the wider part 33 from the caulking part 32 of the corresponding plug blade 30.

The plug outer housing 50 has a tip 50*e* which is flush with a tip 40*e* of the tang 40, and includes a constricted part 51 which becomes gradually thinner from the tip 50*e*. The tip 40*e* of the tang 40 is exposed. The plug outer housing 50 also includes a thicker part 52 continuous from, and on a rear side with respect to, the constricted part 51. The thicker part 52 largely protrudes outward in a diametric direction R of the cord 10 and is thicker than the rest of the plug outer housing 50.

The plug outer housing 50 further includes a tapering part 53, on the rear side with respect to the thicker part 52, which extends continuously from the thicker part 52 and becomes gradually thinner. The tapering part 53 extends to a position of the cord 10 which is distanced from the coupling tube 60 provided on the tip part 15 of the cord 10 in a direction which is along the longitudinal direction X and away from the plug blades 30.

The tapering part 53 of the plug outer housing 50 has a plurality of lengthy slits 53*s* formed in the longitudinal direction X. Each slit 53*s* extends in the circumferential direction. The plurality of slits 53*s* are provided in order to allow the cord 10 to be freely bent in the vicinity of the power supply plug 20.

The tang 40 is formed by insert molding by use of dies 100 and 101. For forming the tang 40, the plug blades 30 and the inner covers 12 exposed at the tip part 15 of the cord 10 are located at prescribed positions in the dies 100 and 101, the prescribed positions being away from each other by a prescribed distance.

After the tang 40 is formed, the coupling tube 60 is formed by injection molding; specifically, the coupling tube 60 is thermally welded to the outer cover 13 at the tip part 15 of the cord 10.

Following the formation of the coupling tube 60, the plug outer housing 50 is formed by insert molding in the state where the elements from the plug blades 30 to the outer cover 13 of the cord 10 are located at prescribed positions in dies 120 and 121.

Specifically, the tang 40 is formed as follows. In the dies 100 and 101, the connection parts 32 of the plug blades 30 are located to be connected to the tips 15*e* of the lead wires 11; the uncovered inner covers 12 are located to extend obliquely as being gradually more distanced from each other; and the insertion parts 31 on the tip side of the plug blades 30 are located to be parallel to each other. In this state, a thermoplastic resin is injected.

As a result of this molding, the tang 40 is obtained. The tang 40 holds the inner covers 12 of the cord 10 such that the inner covers 12 are gradually distanced from each other as approaching the tips thereof, and holds the two plug blades 30 parallel to, and distanced from, each other.

The coupling tube 60 is formed as follows. The tip part 15 of the cord 10 is sandwiched between dies 110 and 111, and a hot melt adhesive of a polyamide resin in a melted state is injected into a tube-like space which is made between the outer cover 13 at the tip part 15 of the cord 10 and the dies 110 and 111 and surrounds the tip part 15. As the dies for forming the coupling tube 60, simple dies are usable.

As a result of this molding, the tube-like coupling tube 60 surrounding the tip part 15 of the cord 10 is obtained. The inner circumferential surface 60*s* of the coupling tube 60 and the outer cover 13 at the tip part 15 of the cord 10 are coupled to, and in close contact with, each other in an airtight manner by thermal welding by heat of the melted resin which is injected into the space made by the dies 110 and 111 for forming the coupling tube 60 by injection molding.

After the coupling tube 60 is formed by injection molding, the plug outer housing 50 is formed as follows. The elements from the plug blades 30 to the outer cover 13 of the cord 10 are located at prescribed positions in the dies 120 and 121, and a thermoplastic resin is injected.

As a result of this molding, the plug outer housing 50 is obtained. The plug outer housing 50 covers, with no gap, a part of the cord 10 and a part of the plug blades 30, specifically, elements from the connection parts 32 of the plug blades 30 to a position of the cord 10 which is distanced from the coupling tube 60 provided on the tip part 15 of the cord 10 in a direction which is along the longitudinal direction X and away from the plug blades 30.

The outer circumferential surface 60*t* of the coupling tube 60 and the plug outer housing 50 are coupled to, and in close contact with, each other in an airtight manner by thermal welding by heat of the melted resin which is injected into the space made by the dies 120 and 121 for forming the plug outer housing 50 by insert molding. In this manner, the power supply plug-provided cord 1 is produced.

A central part of the coupling tube 60 in the longitudinal direction X is positioned in correspondence with the thicker part 52 of the plug outer housing 50, and a rear end 60*f* of the coupling tube 60 is positioned on the tip side with respect to the slits 53*s* of the tapering part 53 of the plug outer housing 50.

The tapering part 53 of the plug outer housing 50 and the outer cover 13 of the cord 10 are not coupled to each other, so that the cord 10 can be freely bent in the vicinity of the power supply plug 20.

Embodiment 2

Figure 9:
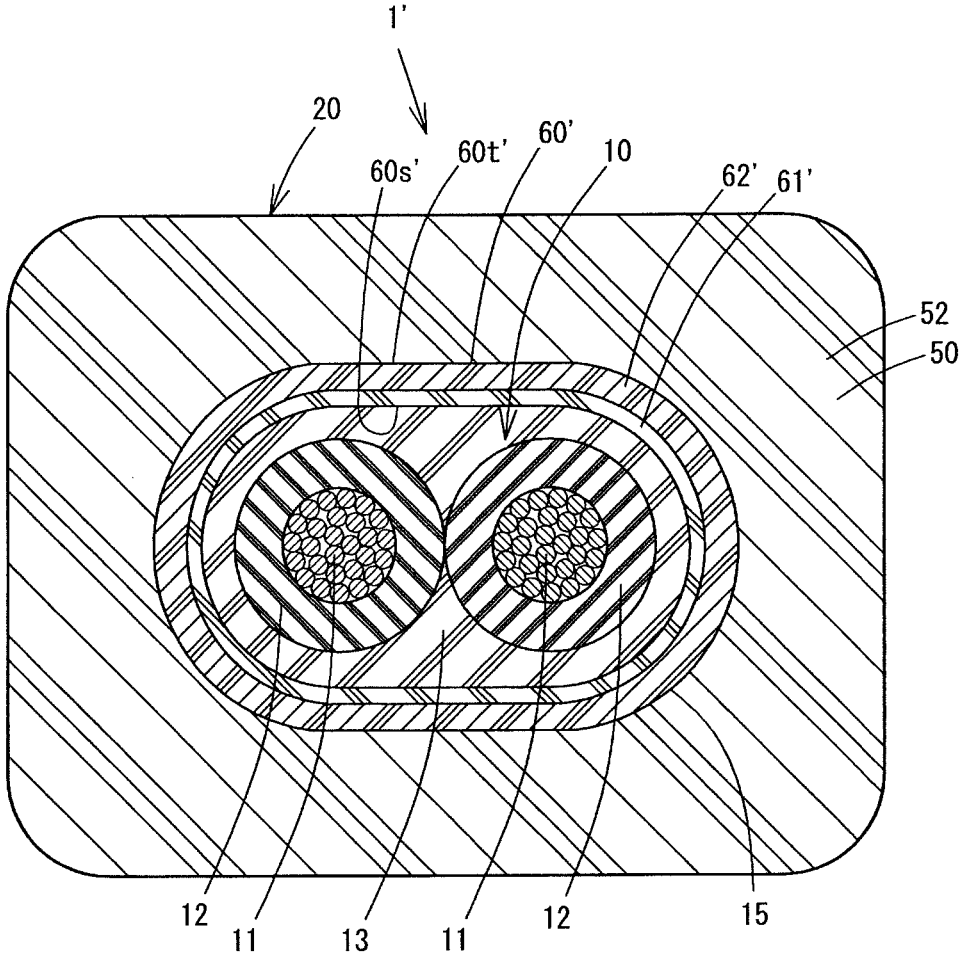
FIG. 9 is an enlarged cross-sectional view of a power supply plug-provided cord in Embodiment 2, taken along a line corresponding to line A-A in FIG. 4.

With reference to FIG. 9, a power supply plug-provided cord 1' in Embodiment 2 according to the present invention will be described. Identical elements as those of the power supply plug-provided cord 1 in Embodiment 1 will bear identical reference numerals thereto, and descriptions thereof will be omitted.

FIG. 9 is an enlarged cross-sectional view of the power supply plug-provided cord 1', corresponding to FIG. 5. More specifically, FIG. 9 shows a cross-section taken along a line corresponding to line A-A in FIG. 4.

The power supply plug-provided cord 1' includes a tube-like two-layer tube 60' including an inner circumferential layer 61' and an outer circumferential layer 62', instead of the coupling tube 60 described above. The two-layer tube 60' is provided on the outer cover 13 at the tip part 15 of the cord 10 in close contact therewith.

The inner circumferential layer 61' is formed of an adhesive, and the outer circumferential layer 62' is formed of poly(vinyl chloride) (PVC). The adhesive may be any appropriate adhesive which is bondable to both of the outer cover 13 formed of rubber and the outer circumferential layer 62' formed of poly(vinyl chloride).

The inner circumferential layer 61' and the outer circumferential layer 62' of the two-layer tube 60' are bonded to each other with no gap.

An inner circumferential surface 60*s'* of the inner circumferential layer 61' of the two-layer tube 60' and the outer cover 13 at the tip part 15 of the cord 10 are also bonded to each other with no gap. The entirety of an outer circumferential surface 60*t'* of the outer circumferential layer 62' of the two-layer tube 60' and the plug outer housing 50 are coupled to, and in close contact with, each other in an airtight manner by thermal welding.

Namely, the inner circumferential surface 60*s'* of the two-layer tube 60' is, along the entire circumference thereof, in close contact with the outer cover 13 of the cord 10, and the outer circumferential surface 60*t'* of the two-layer tube 60' is also, along the entire circumference thereof, in close contact with the plug outer housing 50.

As a result, the close contact between the outer cover 13 of the cord 10 and the plug outer housing 50 is secured along the entire circumference of the cord 10 in the state where the outer cover 13 and the plug outer housing 50 are not easily separated from each other.

Before the plug blades 30 are connected to the tips 15*e* of the cord 10, the two-layer tube 60' is fit into the tip part 15 of the cord 10, and the inner circumferential surface 60*s'* thereof is bonded to the cord 10 with no gap. Thus, the two-layer tube 60' can be in close contact with the cord 10.

Like in Embodiment 1, the outer circumferential surface 60*t'* of the two-layer tube 60' and the plug outer housing 50 are coupled to each other by thermal welding by heat of the melted resin which is injected into the space made by the dies 120 and 121 for forming the plug outer housing 50 by insert molding.

The outer circumferential layer 62' of the two-layer tube 60' may be formed of a heat-contractable material obtained by crosslinking poly(vinyl chloride) (PVC). In this case, the two-layer tube 60' is fit into, and bonded to, the tip part 15 of the cord 10 with no gap and is further heated to be contracted. Thus, the two-layer tube 60' is in close contact with the cord 10 in the state of tightening the cord 10.

The power supply plug-provided cord 1' in Embodiment 2 described above can be produced at lower cost than the power supply plug-provided cord 1 in Embodiment 1.

Embodiment 3

Figure 10:
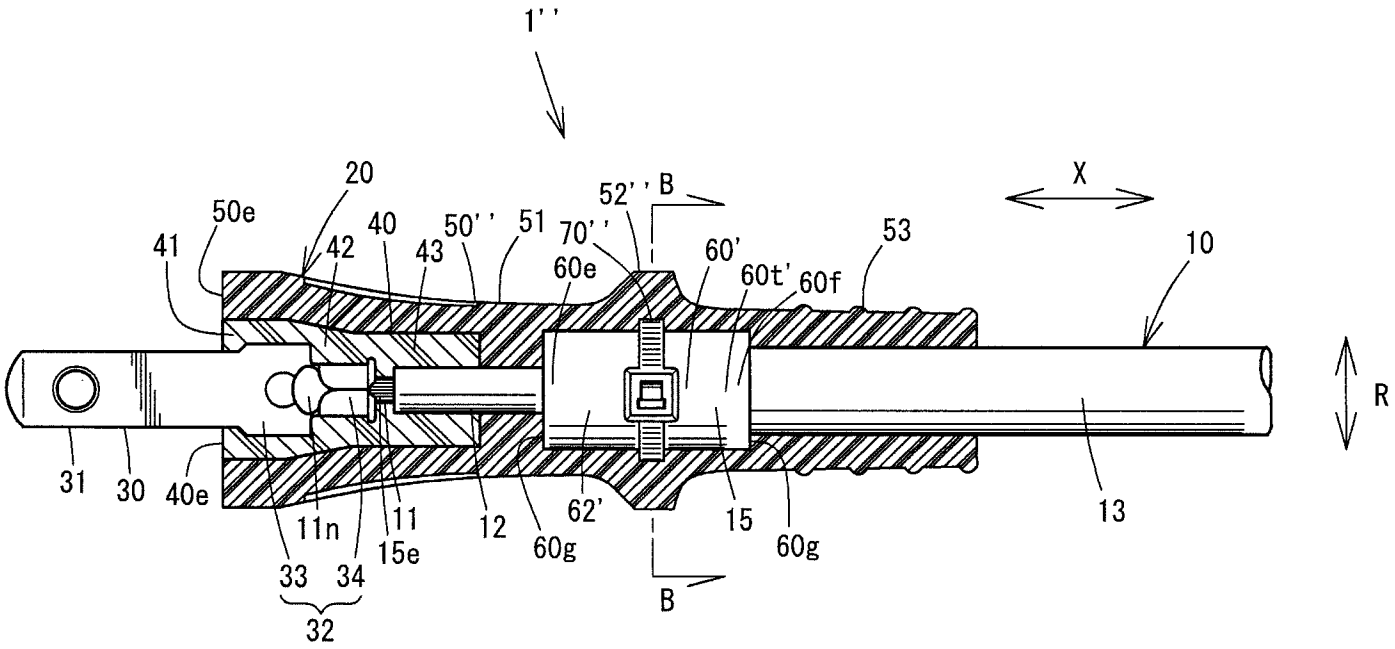
FIG. 10 is a partial vertical cross-sectional view of a power supply plug-provided cord in Embodiment 3.
Figure 11:
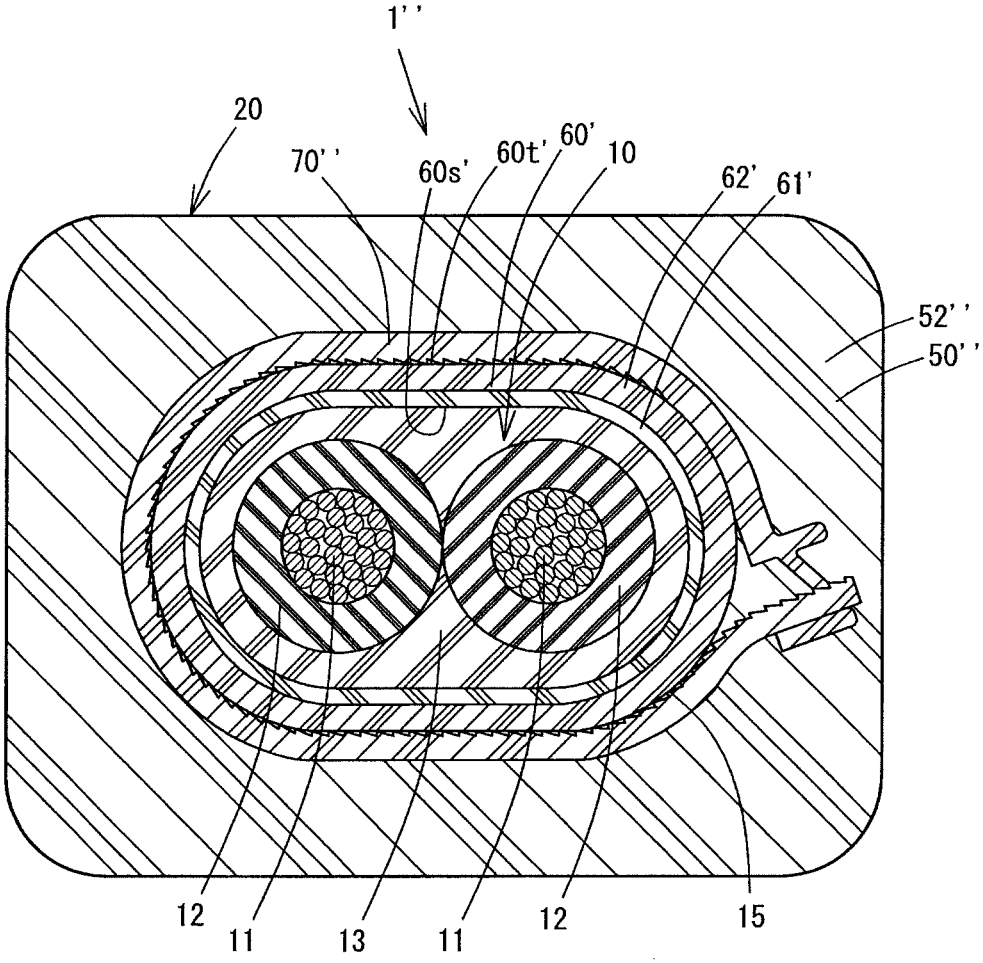
FIG. 11 is an enlarged cross-sectional view of the power supply plug-provided cord in Embodiment 3 taken along line B-B in FIG. 10.

With reference to FIG. 10 and FIG. 11, a power supply plug-provided cord 1" in Embodiment 3 according to the present invention will be described. Identical elements as those of the power supply plug-provided cord 1' in Embodiment 2 will bear identical reference numerals thereto, and descriptions thereof will be omitted.

FIG. 10 is a partial vertical cross-sectional view of the power supply plug-provided cord 1" in Embodiment 3, which corresponds to FIG. 4. FIG. 11 is an enlarged cross-sectional view of the power supply plug-provided cord 1" taken along line B-B in FIG. 10.

The power supply plug-provided cord 1" includes a cable tie 70 tightly wound around an outer circumference of a central part, in the longitudinal direction X, of the two-layer tube 60' described in Embodiment 2. The cable tie 70" is tightly wound around the two-layer tube 60' at a position corresponding to a thicker part 52", in the longitudinal direction X, of a plug outer housing 50" of the cord 10.

The two-layer tube 60' and the cable tie 70" are covered with the plug outer housing 50" with no gap. The outer circumferential surface **60*t'* of the two-layer tube 60' and the plug outer housing 50" are coupled to, and in close contact with, each other in an airtight manner by thermal welding by heat of a melted resin used for forming the plug outer housing 50"**.

The above-described power supply plug-provided cord 1" is produced as follows. The two-layer tube 60' is bonded to the tip part 15 of the cord 10 with no gap. The cable tie 70" is tightly wound around the outer circumference of the central part, in the longitudinal direction X, of the two-layer tube 60'. Then, the plug outer housing 50" is formed to cover the two-layer tube 60' and the cable tie 70" with no gap. Thus, the power supply plug-provided cord 1" is produced.

The power supply plug-provided cord 1" may be tightly wound around the outer circumference of the central part, in the longitudinal direction X, of the coupling tube 60 described in Embodiment 1, instead of the two-layer tube 60'.

The power supply plug-provided cord 1" may include the cable tie 70" tightly wound directly around the outer cover 13 at the tip part 15 of the cord 10, and the cable tie 70" and the coupling tube 60 or the two-layer tube 60' may be covered with the plug outer housing 50" with no gap.

The structures of the power supply plug-provided cord 1, 1' or 1" provides the following functions and effects.

The power supply plug-provided cord 1, 1', 1" in Embodiments 1 through 3 includes the coupling tube 60 or the two-layer tube 60' provided in close contact with the tip part 15 of the cord 10 and coupled to the plug outer housing 50 or 50".

Owing to this, the lead wires 11 can be prevented from being broken at parts thereof connected with the plug blades 30 even when the cord 10 is forcibly pulled out, and also invasion of moisture running on the cord 10 into the inside of the power supply plug 20 can be prevented.

In the power supply plug-provided cord 1 in Embodiment 1, the coupling tube 60 is formed of a hot melt adhesive. Therefore, the coupling tube 60 can be coupled to the plug outer housing 50 and also to the outer cover 13 of the cord 10 in close contact therewith in an airtight manner by thermal welding. Accordingly, the breakage of the lead wires 11 and the invasion of the moisture into the inside of the power supply plug 20 can be prevented with certainty.

The coupling tube 60 can be maintained in such a coupled state in a wide temperature range and has an appropriate level of flexibility even at a low temperature. Therefore, the coupling tube 60 can be secured in close contact with the cord 10 and also with the plug outer housing 50 even in a severe environment of use or in a severe state of use. Accordingly, the breakage of the lead wires 11 and the invasion of the moisture into the inside of the power supply plug 20 can be prevented with certainty.

In the power supply plug-provided cord 1' in Embodiment 2, the inner circumferential layer 61' of the two-layer tube 60' is formed of an adhesive which is bondable to the outer cover 13 of the cord 10 and the outer circumferential layer 62'. Therefore, the two-layer tube 60' can be bonded to the outer cover 13 of the cord 10. Accordingly, the breakage of the lead wires 11 and the invasion of the moisture into the inside of the power supply plug 20 can be prevented with certainty.

In the case where the outer circumferential layer 62' of the two-layer tube 60' of the power supply plug-provided cord 1' in Embodiment 2 is formed of a heat-contractable material, the two-layer tube 60' is thermally contracted and thus can be in close contact with the cord 10 in the state of tightening the cord 10.

The power supply plug-provided cord 1, 1', 1" in Embodiments 1 through 3 includes the coupling tube 60 or the two-layer tube 60' provided in a tube-like shape. Owing to this shape, the coupling tube 60 or the two-layer tube 60' can be coupled to the plug outer housing 50, 50", and also can be coupled to (in close contact with) the outer cover 13, in a large area. Accordingly, the breakage of the lead wires 11 and the invasion of the moisture into the inside of the power supply plug 20 can be prevented with certainty.

The power supply plug-provided cord 1" in Embodiment 3 includes the cable tie 70" tightly wound around the outer circumference of the two-layer tube 60'. Therefore, the close contact of the two-layer tube 60' to the tip part 15 of the cord 10 can be made stronger.

In addition, when the cord 10 is forcibly pulled out, the cable tie 70" can be engaged with the plug outer housing 50". Therefore, the breakage of the lead wires 11 and the invasion of the moisture into the inside of the power supply plug 20 can be prevented with certainty. Moreover, these effects can be provided by a space-saving structure.

The cable tie 70" may be tightly wound directly around the outer cover 13 of the cord 10 in the power supply plug-provided cord 1" in Embodiment 3. In this case, when the cord 10 is forcibly pulled out, the cable tie 70" is engaged with the plug outer housing 50". In addition, the coupling tube 60 or the two-layer tube 60' can be in contact with the plug outer housing 50" in a large area. Accordingly, the breakage of the lead wires 11 and the invasion of the moisture into the inside of the power supply plug 20 can be prevented with certainty.

The electrical plug-provided cord according to the present invention corresponds to the power supply plug-provided cord 1, 1' or 1" in the above-described embodiments; and similarly, the outer cover corresponds to the outer cover 13;

the electrical plug corresponds to the power supply plug 20;

the base part corresponds to the connection part 32;

the coupling member corresponds to the coupling tube 60 or the two-layer tube 60';

the interface with the outer cover corresponds to the inner circumferential surface **60*s* or 60*s'*; and the interface with the plug outer housing corresponds to the outer circumferential surface 60*t* or 60*t'***.

However, the present invention is not limited to the above-described embodiments, and may be carried out in various other embodiments.

For example, the power supply plug-provided cord 1, 1' or 1" in each of the above-described embodiments may be produced as follows. The coupling tube 60 or the two-layer tube 60' is bonded to the tip part 15 of the cord 10 by melt-bonding. Then, an adhesive is applied to an end surface **60*g* of the coupling tube 60 or the two-layer tube 60'. The plug outer housing 50 or 50" is formed, and the end surface 60*g* and the plug outer housing 50 or 50" are bonded to each other. Thus, the power supply plug-provided cord 1, 1' or 1"** is produced.

Alternatively, for example, the power supply plug-provided cord 1, 1' or 1" in each of the above-described embodiments may be produced as follows. After the plug outer housing 50 or 50" is formed, an adhesive is applied to the outer cover 13 of the cord 10 and the tapering part 53 of the plug outer housing 50 or 50" to bond the outer cover 13 and the tapering part 53. Thus, the power supply plug-provided cord 1, 1' or 1" is produced.

Owing to these structures, the breakage of the lead wires 11 and the invasion of the moisture into the inside of the power supply plug 20 can be prevented with certainty.

DESCRIPTION OF THE REFERENCE NUMERALS

1, 1', 1" . . . Power supply plug-provided cord
10 . . . Cord
11 . . . Lead wire
13 . . . Outer cover
15 . . . Tip part
15*e* . . . Tip
20 . . . Power supply plug
30 . . . Plug blade
32 . . . Connection part
50, 50" . . . Plug outer housing
60 . . . Coupling tube
60' . . . Two-layer tube
60*s*, 60*s'* . . . Inner circumferential surface
60*t*, 60*t'* . . . Outer circumferential surface
61' . . . Inner circumferential layer
62' . . . Outer circumferential layer
70" . . . Cable tie

What is claimed is:

1. An electrical plug-provided cord, comprising:
lead wires;
an inner cover for covering the lead wires;
an electrical plug including plug blades connected to the lead wires exposed from a tip of the inner cover;
a tang for surrounding a connection between the plug blades and the lead wires; an outer cover for covering the inner cover;
a coupling member for covering the outer cover, and a part of the inner cover exposed from a tip of the outer cover;
a plug outer housing for covering base parts of the plug blades, the tang, the part of the inner cover exposed from the tip of the outer cover, and the coupling member, the plug outer housing being formed of a synthetic resin,
wherein at least an interface of the coupling member with the plug outer housing is formed of a heat-weldable material which is thermally weldable with the plug outer housing; and
the coupling member is coupled to the plug outer housing.

2. An electrical plug-provided cord according to claim 1, wherein the coupling member is formed of a hot melt adhesive.

3. An electrical plug-provided cord according to claim 1, wherein:
the coupling member has a two-layer structure including an outer circumferential layer and an inner circumferential layer; and
the outer circumferential layer is formed of the heat-weldable material, and the inner circumferential layer is formed of an adhesive which is bondable to the outer circumferential layer and the cord.

4. An electrical plug-provided cord according to claim 1, wherein the coupling member is formed of a heat-contractable material.

5. An electrical plug-provided cord according to according to claim 1, wherein the coupling member has a tube-like shape.

6. An electrical plug-provided cord according to claim 5, further comprising a cable tie tightly wound around an outer circumference of the coupling member.

7. An electrical plug-provided cord according to claim 1, wherein a cable tie is tightly wound around an outer circumference of the outer cover at the tip part of the cord.

8. A method for producing an electrical plug-provided cord including a cord which includes lead wires and an outer cover for covering the lead wires; and an electrical plug which includes plug blades connected to the lead wires at a tip of the cord and a plug outer housing for covering a part of the cord and a part of the plug blades from base parts of the plug blades to the outer cover at a tip part of the cord, the plug outer housing being formed of a synthetic resin; the method comprising:
providing a tang for surrounding a connection between the plug blades and the lead wires;
providing a coupling member so as to surround the tip part of the cord in close contact therewith, wherein at least an interface of the coupling member with the plug outer housing is formed of a heat-weldable material which is thermally weldable with the plug outer housing;
providing a plug outer housing for covering base parts of the plug blades, the tang, the part of the inner cover exposed from the tip of the outer cover, and the coupling member, the plug outer housing being formed of a synthetic resin; and
coupling the coupling member and the plug outer housing to each other by thermal welding by heat of a melted resin generated during insert molding performed to form the plug outer housing.

* * * * *